US006499781B1

(12) United States Patent
Flynn

(10) Patent No.: US 6,499,781 B1
(45) Date of Patent: Dec. 31, 2002

(54) DEVICE FOR CARRYING A LOAD

(76) Inventor: Norman Homer Flynn, Apt. EC305 807 East 6th Avenue, Vancouver, British Columbia (CA), V5T 1L9

( * ) Notice: Subject to any disclaimer, the term of this patent is extended or adjusted under 35 U.S.C. 154(b) by 0 days.

(21) Appl. No.: 09/964,617

(22) Filed: Sep. 28, 2001

(51) Int. Cl.[7] ..... B65D 33/06

(52) U.S. Cl. ..... 294/159; 294/170

(58) Field of Search ..... 294/137, 143, 294/153, 158, 159, 162, 163, 166, 170, 171; 16/422, 428; 224/267, 268; 383/6, 13, 25; D9/434, 455

(56) References Cited

U.S. PATENT DOCUMENTS

| | | | | | |
|---|---|---|---|---|---|
| 270,917 | A | * | 1/1883 | Turner | 294/170 |
| 1,570,025 | A | * | 1/1926 | Young | 294/170 X |
| D137,712 | S | * | 4/1944 | Miano | 294/170 X |
| D159,141 | S | | 6/1950 | Conrad | |
| 2,684,797 | A | | 7/1954 | Schulte | |
| 2,782,915 | A | | 2/1957 | Fahringer | |
| 3,306,507 | A | | 2/1967 | Wilson | |
| 3,335,828 | A | * | 8/1967 | Simms | 294/170 X |
| 4,420,178 | A | | 12/1983 | Taylor et al. | |
| D290,935 | S | | 7/1987 | Williams | |
| 4,791,702 | A | | 12/1988 | McVey | |
| 4,841,596 | A | | 6/1989 | Fink | |
| D318,213 | S | | 7/1991 | Cloonan et al. | |
| D319,569 | S | | 9/1991 | Clark | |
| D326,613 | S | | 6/1992 | Babcock et al. | |
| D340,863 | S | | 11/1993 | Daigle | |
| 5,368,393 | A | | 11/1994 | Normann | |
| 5,433,494 | A | | 7/1995 | Du Buisson | |
| 5,447,259 | A | | 9/1995 | Erickson | |
| D363,664 | S | | 10/1995 | Muchnick | |
| 5,507,544 | A | | 4/1996 | McQuade et al. | |
| 5,615,921 | A | | 4/1997 | Marley et al. | |
| 5,667,266 | A | | 9/1997 | Giocanti | |
| D400,785 | S | | 11/1998 | Randall | |
| 5,894,972 | A | * | 4/1999 | Brown | 294/170 X |
| 5,938,256 | A | | 8/1999 | Lovette | |
| 5,992,803 | A | | 11/1999 | LeRoux | |
| D417,393 | S | * | 12/1999 | DiMeo et al. | D9/434 |
| 6,045,019 | A | | 4/2000 | Moses | |
| 6,049,948 | A | | 4/2000 | Leonardi | |
| 6,098,933 | A | | 8/2000 | Stein | |
| D441,653 | S | * | 5/2001 | LeRoux | D9/434 |

FOREIGN PATENT DOCUMENTS

| | | | | |
|---|---|---|---|---|
| GB | 2263228 | * | 7/1993 | 294/170 |

* cited by examiner

*Primary Examiner*—Johnny D. Cherry
(74) *Attorney, Agent, or Firm*—Oyen Wiggs Green & Mutala

(57) ABSTRACT

A device for carrying a load, such as plastic bags that are used for carrying items purchased at supermarkets. The device can be used to carry the load by hand, on a shoulder or on a forearm. The device has a central portion, including a handle and a spaced apart support member defining a non-collapseable opening dimensioned to receive a hand. The support member has a concave downwardly facing surface for securely positioning the device on a shoulder or forearm. Hooks are attached on opposite ends of the central portion for receiving at least one load handle. Free end portions of the hooks are in resilient contact with the central portion.

7 Claims, 2 Drawing Sheets

DEVICE FOR CARRYING A LOAD

TECHNICAL FIELD

The present invention pertains to devices for carrying a load, such as plastic bags, by hand, on a shoulder or on a forearm.

BACKGROUND

Plastic bags are commonly used for carrying food and other items purchased from stores and supermarkets. The plastic bags typically have loop handles that a person carries with his hands. When a plastic bag is filled, the loop handles tend to stretch and otherwise dispose themselves in a manner that concentrates the weight of the bag's contents along narrow areas of a person's hand. This can prove painful when the bag is carried for any extended period of time or distance. This problem is exacerbated when multiple bags are carried simultaneously.

It is known to use a hand-held device for carrying multiple bags. For the most part, the previous devices have comprised a central member with some type of hooks or grooved portions at the opposite ends of the central member. The central member is to be grasped by hand and the bag loop handles are to be supported by the hooks or grooved portions when the bags are carried.

It is useful to be able to use a device to not only carry bags by hand, but also on a forearm or on a shoulder. Positioning a device on a forearm or shoulder may be done for either a temporary period of time (e.g. to allow a person to free his hands to open a car door, to retrieve a set of keys from a pocket, to hold a child's hand, etc.) or for a longer period of time, such as when multiple bags are carried over longer distances. Alternatively, when a person has numerous bags to carry, it is useful to carry some bags with a device positioned on a shoulder and/or a forearm and to carry other bags by hand with another device. This prevents the need for making multiple trips to carry the bags.

However, in order for a device to be used to carry bags on a shoulder or a forearm, the device must rest securely and comfortably. Previous devices which were not designed to ergonomically fit the shape of a person's shoulder or forearm, such as those having flat bottom surfaces, would be uncomfortable for the user or would be unstable during use, causing the device to fall off the shoulder or forearm, possibly causing damage to the contents of the bags.

There have been some attempts to provide devices capable of carrying bags by hand or on a shoulder or forearm. U.S. Pat. No. 6,045,019 issued to Moses discloses a strap for carrying shopping bags that is made of a thin sheet that has opposed hook-like lateral openings on each end for receiving bag handles. The strap is longitudinally flexible and is capable of being slung over a person's shoulder with bags on either side thereof.

U.S. Pat. No. 5,667,266 issued to Giocanti discloses a grip for carrying bags with loop handles with ends shaped to form hooks for carrying the bags and that is capable of being carried by hand or on a shoulder or forearm.

However, a user cannot easily remove the devices of Moses and Giocanti from his shoulder or forearm since these devices have a "low" profile when slung over a shoulder or forearm and while supporting the weight of the bags. For example, a person would have to dig his fingers under the central portion of the Moses strap in order to lift it from his shoulder. This may prove awkward or may place unnecessary stress on a person's fingers if the load carried by the device is heavy. The flexible Giocanti device suffers from the same disadvantage since it collapses under the weight of a load, providing no convenient location for a person to insert his fingers to lift the device from his shoulder.

It is also useful to be able to place the device down for a short period of time (e.g. for a person to open a door, to retrieve keys, etc.) when the bags are received by the hooks or grooves without worry that the loop handles will inadvertently become disengaged, necessitating the person having to re-place the loop handles within the hooks or grooves before picking the device up again. For this reason, devices that have a fixed space or gap between the hook and the central member may result in the undesired exit of the bag loop handles.

SUMMARY OF INVENTION

The present invention provides for an easy-to-use, lightweight device for comfortably and securely carrying a load, such as plastic bags, by hand, on a shoulder or on a forearm. The device is comfortable to use and is stable when in use.

In one aspect of the invention, there is provided a device for carrying a load by hand, on a shoulder or on a forearm, the load having at least one load handle, the device comprising: an elongated central portion comprising a support member having a concave downwardly facing surface and a handle spaced apart from and above the support member to define a non-collapseable opening dimensioned to receive a hand for carrying a load by hand; and a pair hooks attached at opposite longitudinal ends of the central portion for receiving at least one load handle, wherein each of the hooks comprises a free end portion in resilient contact with the central portion, wherein a load handle confinement area is defined between each hook and the central portion.

The support member may have a greater transverse width than the handle.

The device may be integrally constructed. The device may be constructed of a plastic material.

The handle may be a longitudinally extending bar disposed above the support member, the hooks may be upwardly oriented and the free end portions of the hooks may be in resilient contact with the central portion at locations on opposite ends of the handle. The bar may comprise an upwardly facing first surface and a downwardly facing second surface, wherein the transverse edges of the first surface and the second surface are rounded. The central portion may comprise radiused bend portions on opposite ends of the bar and the free end portions of the hooks may be in resilient contact with the central portion at or near the radiused bend portions. The central portion may comprise a pair of downwardly extending arms, each of the arms being attached at a first end to the radiused bend portion and attached at a second end to the support member.

The hooks may be symmetrical with one another and may be upwardly oriented. The hooks and the central portion may be coplanar.

Each of the hooks may comprise a bottom portion attached to the central portion adjacent the load handle confinement area, wherein each of the bottom portions of the hooks may have an upwardly facing surface for supporting at least one load handle in the load handle confinement area and the upwardly facing surface may have rounded transverse edges. Each of the hooks may comprise an intermediate portion between the free end portion and the bottom portion, the intermediate portions being spaced apart from the central portion. The bottom portions of the hooks may have greater transverse widths than the free end portions of the hooks.

The central portion may comprise a member disposed below the handle, the member having an upwardly facing surface having rounded transverse edges, the upwardly facing surface defining the bottom of the non-collapseable opening. This member may be the support member.

The transverse width of the device may be greater at its bottom than at its top so that the device has a generally triangular cross-sectional profile.

In another aspect of the invention, there is provided a device integrally constructed from a plastic material for carrying a load by hand, on a shoulder or on a forearm, the load having at least one load handle, the device comprising: an elongated central portion comprising: a longitudinally extending support member having a concave downwardly facing first surface and an upwardly facing first surface, the second surface of the support member having rounded transverse edges; and a longitudinally extending bar disposed above the support member, radiused bend portions on opposite longitudinal ends of the bar and a pair of downwardly extending arms, each of the arms being attached at a first end to the radiused bend portion and attached at a second end to the support member, the bar comprising an upwardly facing first surface and a downwardly facing second surface, wherein the transverse edges of the first and second surfaces of the bar are rounded, wherein a non-collapseable opening is defined between the bar and the support member dimensioned to receive a hand for carrying a load by hand, wherein the support member has a greater transverse width than the bar; and a pair of upwardly oriented hooks that are coplanar with the central portion, the hooks are attached at opposite longitudinal ends of the central portion for receiving at least one load handle, the hooks being symmetrical with one another, wherein each of the hooks comprises a free end portion in resilient contact with the central portion, a bottom portion attached to the central portion and an intermediate portion between the free end portion and the bottom portion and spaced apart from the central portion, wherein a load handle confinement area is defined between each of the hooks and the central portion, wherein each of the bottom portions of the hooks has an upwardly facing surface for supporting at least one load handle in the load handle confinement area, the upwardly facing surface of the bottom portion having rounded transverse edges.

DESCRIPTION

Figure 1:
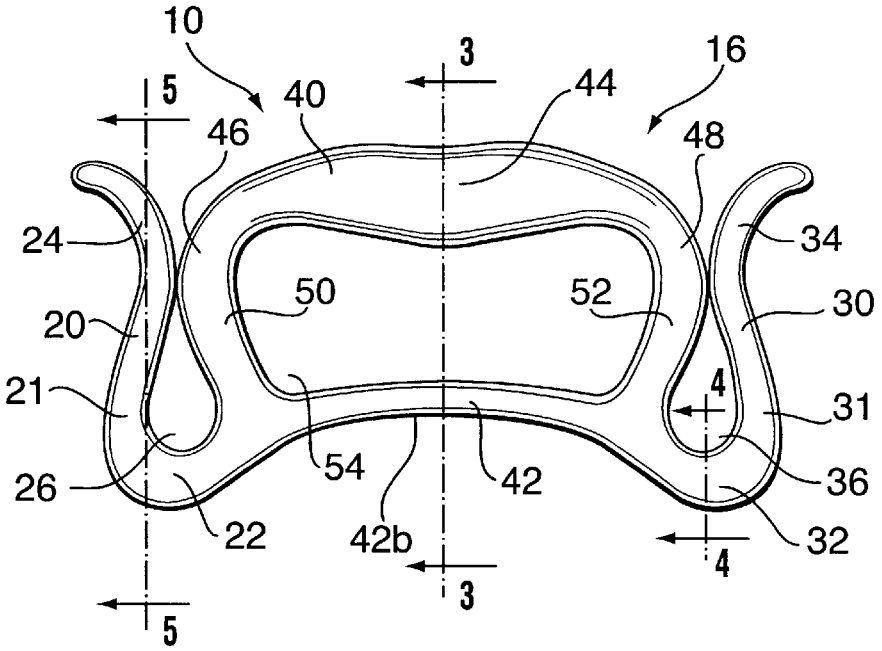
FIG. 1 is a front elevation view of a device according to the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

A device 10 for carrying a load by hand, on a shoulder or on a forearm is illustrated in the drawings. For illustration purposes, the load described and illustrated herein is two plastic bags 12, each having two loop handles 14, such as those commonly used to carry food and groceries purchased from supermarkets and the like. It will be appreciated by those skilled in the art, however, that device 10 could also be used to carry any number of different items having at least one handle capable of being received by device 10. In this sense, the term "load" as used herein is not restricted to plastic bags 12 with loop handles 14, but encompasses one or more items, each having at least one load handle capable of being received by the device of this invention.

In the illustrated embodiment of the invention, device 10 comprises elongated central portion 16 and hooks 20, 30 for receiving at least one load handle. Hooks 20, 30 each have a bottom portion 22, 32, an intermediate portion 21, 31 and a free end portion 24, 34. Hooks 20, 30 are attached to central portion 16 at opposite longitudinal ends thereof by hook bottom portions 22, 32.

In the illustrated embodiment of the invention, central portion 16 comprises a handle 40 and an attached support member 42 disposed below the handle 40. In the illustrated embodiment of the invention, handle 40 comprises a longitudinally extending bar 44. Central portion 16 comprises radiused bend portions 46, 48 at opposite ends of bar 44, and downwardly extending arms 50, 52. Radiused bend portions 46, 48 are attached to arms 50, 52, respectively. Arms 50, 52 are each attached to support member 42.

An opening 54 is defined between bar 44 and support member 42. Opening 54 is dimensioned to receive a hand for carrying the device 10 by hand. More specifically, device 10 is to be carried by hand by a user inserting his fingers within opening 54 below bar 44. Once the fingers are inserted, bar 44 is then grasped by curling the fingers around bar 44. The user can then carry device 10 by hand to carry a load.

Figure 3:
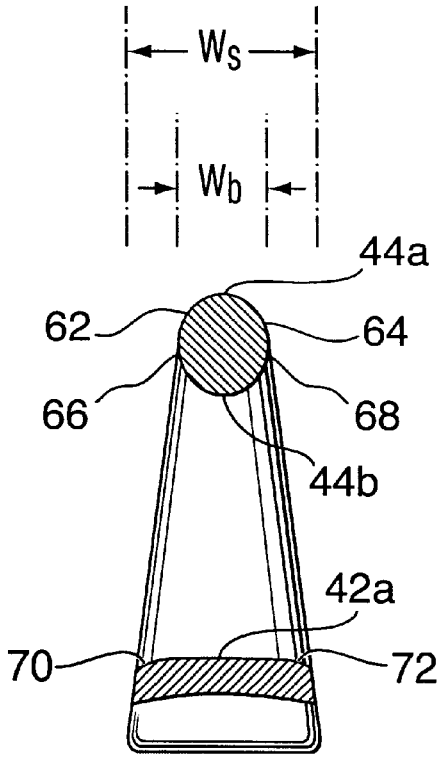
FIG. 3 is a cross-sectional view taken along the line 3—3 in FIG. 1.

Bar 44 has an upwardly facing surface 44*a* and a downwardly facing surface 44*b* (see FIG. 3). The transverse edges 62, 64, 66, 68 of surfaces 44*a* and 44*b* are rounded, giving bar 44 cross-sectional profile that makes bar 44 fit the natural shape of a hand, making bar 44 comfortable to hold by hand. This is advantageous whenever a load must be carried for any extended period of time or distance.

Support member 42 is disposed below bar 44. Support member 42 has an upwardly facing surface 42*a* and a downwardly facing surface 42*b*. The transverse edges 70, 72 of upwardly facing surface 42*a* are rounded (see FIG. 3) so as to prevent a user from inadvertently catching his fingers on support member 42 when inserting them into opening 54.

Downwardly facing surface 42*b* of support member is concave (see FIGS. 1 and 2) and is to be positioned on a user's shoulder or forearm whenever it is desired to carry a load on a shoulder or forearm using device 10. For example, when using device 10 to carry a load on a shoulder, device 10 is placed on the user's shoulder so that downwardly facing concave surface 42*b* rests on top of the shoulder. Bags 12 hanging from hooks 20, 30 would hang over either side of the shoulder so that bag(s) 12 hanging from hook 20 (or hook 30 if device 10 was positioned in the opposite direction) would fall over the rear of the shoulder and against the user's back, while bag(s) 12 hanging from hook 30 (or hook 20 if device 10 was positioned in the opposite direction) would fall over the front of the shoulder and against the user's chest. The concavity of downwardly facing surface 42*b* of support member 42 allows device 10 to be securely positioned in place on the user's shoulder.

Without this concavity, device 10 would be unstable on the user's shoulder so that any sudden movements, or any weight imbalance in the bags across device 10, may cause the device 10 to become dislodged, causing the device 10 and bags 12 to fall from the user's shoulder, possibly causing damage to the contents of bags 12.

Device 10 could be similarly used to carry a load on a user's forearm by placing device 10 across the user's forearm with the concavity of surface 42*b* of support member 42 following the natural shape of the user's forearm. In this case, the bags 12 hanging from opposite ends of device 10 would hang on opposite sides of the user's forearm. Again, this allows the device 10 to be securely positioned when it is used to carry a load on a forearm.

Support member 42 is slightly elastic so that support member flexes slightly to conform to the movement of the shoulder or forearm when device 10 bears the weight of a carried load. This elasticity provides added stability for device 10 when so used and also provides added comfort for the user since device 10 absorbs some of the shock when walking with a load.

Support member 42 has a greater transverse width than bar 44. This is shown in FIG. 3 where the transverse width of support member 42 (Ws) is greater than the transverse width of handle bar 44 (Wb). The greater transverse width of support member 42 than bar 44 helps maintain device 10 in a generally upright position when carrying a load, thus contributing to the general stability of the device 10, particularly when used to carry a load on a shoulder or a forearm.

Hooks 20, 30 are upwardly oriented and are symmetrical with one another. Hooks 20, 30 are coplanar with central member 16. When device 10 does not bear the weight of a load the free end portions 24, 34 of hooks 20, 30 are in resilient contact with central portion 16 at or near radiused bend portions 46, 48 of handle 40 (see FIG. 1). Load handle confinement areas 26, 36 are defined between hooks 20, 30, respectively, and central portion 16. Hook intermediate portions 21, 31 are each spaced apart from arms 50, 52, respectively.

Bags 12 are received by device 10 by passing loop handles 14 over free end portions 24, 34 of hooks 20, 30 and down into load handle confinement areas 26, 36 adjacent bottom portions 22, 32 of hooks 20, 30. Device 10 is constructed of an elastic material so as to allow free end portions 24, 34 to be spaced apart and out of contact with central portion 16 when loop handles 14 are threaded over free end portions 24, 34 and into load handle confinement areas 26, 36. This elasticity similarly allows the spacing of free end portions 24, 34 from central portion 16 when it is desired to remove loop handles 14 from load handle confinement areas 26, 36. Under sufficient weight from hanging bags 12, free end portions 24, 34 of hooks 20, 30 may remain spaced apart from radiused bend portions 46, 48 (see FIG. 2). However, free end portions 24, 34 of hooks 20, 30 are resiliently biased towards contact with the central portion 16 as shown in FIG. 1 and are in such contact when device 10 does not bear the weight of a load. The resilient contact between hooks 20, 30 closes load handle confinement areas 26, 36 when device does not bear the weight of bags 12, thus preventing the undesired exit of the loop handles 14. This is beneficial since it is desirable for a user to be able to temporarily put down a load of bags engaged by device 10 in certain situations (e.g. when stored in the trunk of the car after shopping, to retrieve keys from a pocket, etc.) without worry that some or all of the loop handles 14 have become disengaged when he goes to lift the device 10 again.

Figure 4:
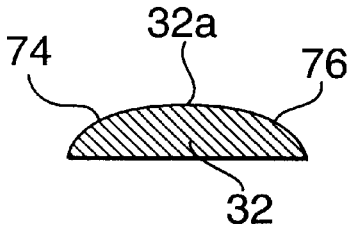
FIG. 4 is a cross-sectional view taken along line 4—4 in FIG. 1.

Each of load handle confinement areas 26, 36 is capable of supporting at least one load handle, such as bag loop handles 14. FIG. 4 illustrates a cross sectional view of the bottom portion 32 of hook 30 (though not illustrated, bottom portion 22 of hook 20 has an identical cross-sectional profile). As shown in FIG. 4, bottom portion 32 has an upwardly facing surface 32*a* which has rounded transverse edges 74, 76.

The rounded transverse edges of the upwardly facing surfaces of the bottom portions 22, 32 of hooks 20, 30 help prevent the undesired tearing of load handles, such as loop handles 14, when they are hanging from device 10.

Figure 5:
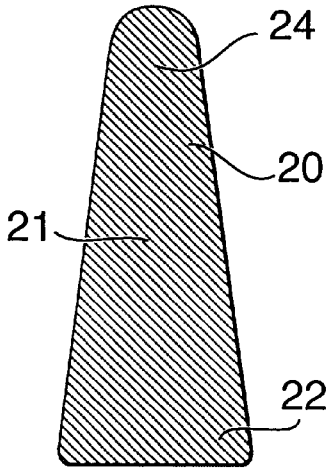
FIG. 5 is a cross-sectional view taken along line 5—5 in FIG. 1.

FIG. 5 illustrates a cross sectional view of hook 20 (though not illustrated, hook 30 has an identical cross-sectional profile). As illustrated, the transverse width of bottom portion 22 is greater than that of free end portion 24. This is similar to the relationship between the transverse width of support member 42 and handle bar 44. FIGS. 3 and 5 illustrate that device 10 has a generally triangular cross-sectional profile in that the transverse width of device 10 is greater at its bottom than at its top. This generally triangular cross-sectional profile contributes to device 10 being very stable when in use.

Figure 2:
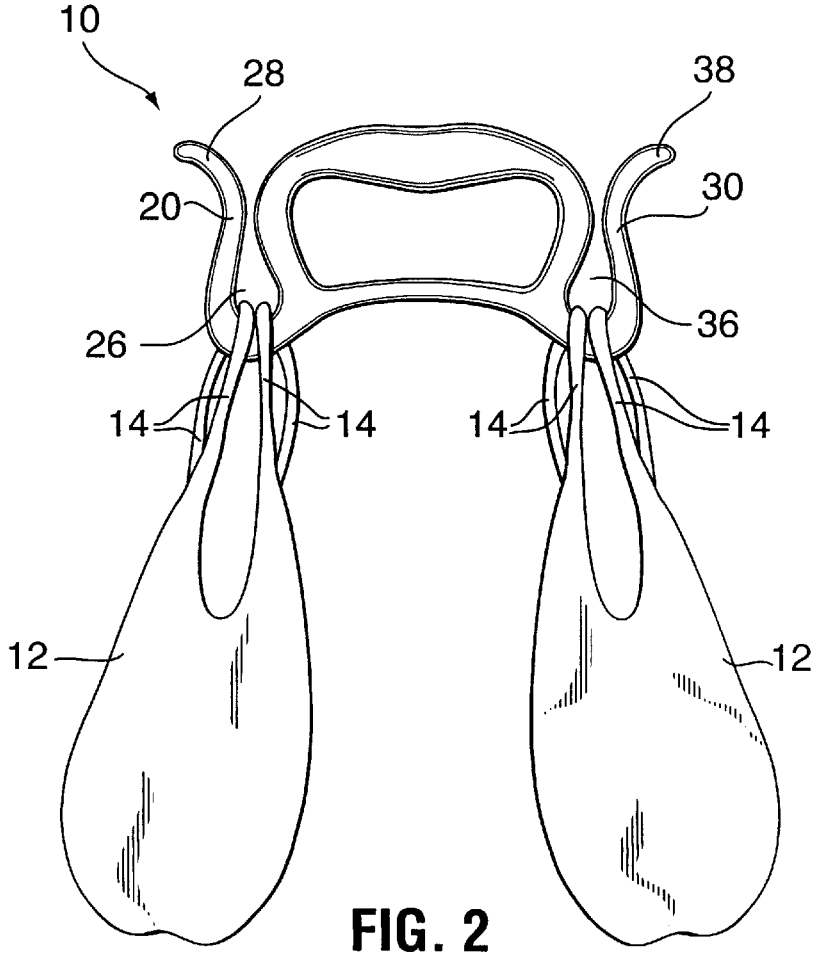
FIG. 2 is a front elevation view of the device of FIG. 1 having bags with loop handles supported from both ends.

FIG. 2 illustrates loop handles 14 of bags 12 being supported by bottom portions 22, 32 of hooks 20, 30 within load handle confinement areas 26, 36. The opposed curvatures of radiused bend portions 46, 48 and the top ends 28, 38 of free end portions 24, 34 help funnel loop handles 14 over free end portions 24, 34 of hooks 20, 30 and down into load handle confinement areas 26, 36.

If is desired to carry the load by hand, this is accomplished by the user inserting his fingers into opening 54 and grasping handle bar 44. The user then simply holds handle bar 44, carrying device 10 (and consequently the load of bags 12) at his side. Alternatively, a load can be carried by a user positioning downwardly facing surface 42*b* of support member 42 on his shoulder or on his forearm. In the event that device 10 is used to carry a load on a shoulder or forearm, it is important to note that opening 54 is non-collapseable under the weight of a load such as bags 12. That is, handle 40 does not bend substantially under the weight of a normal load in the normal use of the device 10, preventing bar 44 from falling into contact with support member 42. A user can thus easily and quickly pick the device 10 off of his shoulder or forearm by inserting his fingers into non-collapseable opening 54, grasping bar 44 and lifting the device 10, avoiding the need to awkwardly dig his fingers under support member 42 to lift device off of his shoulder or forearm, which would be difficult or painful when the device 10 is under the weight of a load.

Device 10 can be constructed of polypropylene or any other suitable plastic material having the desired characteristics. Device 10 is lightweight to carry and is conveniently sized to be carried in a pocket when not in use. Device 10 has been shown as having an integral construction wherein all of its constituent part are integrally formed. For example, device 10 could be constructed by well-known injection molding techniques. It will be appreciated, however, that such an integral construction is not essential to the invention.

FIG. 2 has illustrated the use of device 10 for carrying two bags 12. It will be appreciated by those skilled in the art that more than one bag (or other item) could be carried on each of hooks 20, 30. The maximum number of items capable of being carried by device 10 will depend in each case upon a number of factors including the weight and size of the items. Similarly, it will be appreciated that device 10 can be used to carry a load having unequal weight distribution on the two ends of device 10. For example, device 10 could be used to carry a single item (e.g. bag 12) on either of hooks 20, 30 without another item on the opposite hook. Such cases of unequal weight distribution can be conveniently dealt with by the user shifting his fingers along the length of handle bar 44 in the appropriate direction to leverage the unequal weight distribution.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for carrying a load by hand, on a shoulder or on a forearm, said load having at least one load handle, said device comprising;

an elongated central portion comprising a longitudinally extending support member having a concave downwardly facing first surface and an upwardly facing second surface, and a handle spaced apart from and above said support member to define a non-collapseable opening dimensioned to receive a hand for carrying a load by hand, said handle comprising a longitudinally extending bar disposed above said support member, radiused bend portions on opposite longitudinal ends of said bar and a pair of downwardly extending arms, each of said arms being attached at a first end to said radiused bend portion and attached at a second end to said support member, said bar comprising an upwardly facing first surface and a downwardly facing second surface, wherein the support member has a greater transverse width than said bar; and a pair of upwardly oriented hooks that are coplanar wit said central portion, said hooks are attached at opposite longitudinal ends of said central portion for receiving at least one load handle, wherein each of said hooks comprises a free end portion in resilient contact with said central portion, a bottom portion attached to said central portion and an intermediate portion between said free end portion and said bottom portion and spaced apart from said central portion, wherein a load handle confinement area is defined between each of said hooks and said central portion, wherein each of said bottom portions of said hooks has an upwardly facing surface for supporting at least one load handle in said load handle confinement area.

2. The device of claim 1 wherein said second surface of said support member, said transverse edges of said first and second surfaces of said bar, and said upwardly facing surface of said bottom portion of said hooks are all rounded.

3. The device of claim 1 wherein said device is integrally constructed.

4. The device of claim 3 wherein said device is constructed of a plastic material.

5. The device of claim 1 wherein said hooks are symmetrical with one another.

6. The device of claim 1 wherein said bottom portions of said hooks have greater transverse widths than said free end portions of said hooks.

7. The device of clam 1 wherein the transverse width of said device is greater at a lower portion of the device than at an upper portion of the device so that said device has a generally triangular cross-sectional profile.

* * * * *